US006863556B2

(12) United States Patent
Viklund et al.

(10) Patent No.: US 6,863,556 B2
(45) Date of Patent: Mar. 8, 2005

(54) AXIAL LATCH ACTUATOR

(75) Inventors: Mark Viklund, New Milford, CT (US); Kevin Stronkowsky, Middlebury, CT (US); Denny Lo, Danbury, CT (US); Maxwell Yip, Trumbull, CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 10/408,976

(22) Filed: Apr. 8, 2003

(65) Prior Publication Data

US 2003/0220008 A1 Nov. 27, 2003

Related U.S. Application Data

(60) Provisional application No. 60/375,786, filed on Apr. 26, 2002.

(51) Int. Cl.[7] ..... H01R 13/627
(52) U.S. Cl. ..... 439/354
(58) Field of Search ..... 439/344, 354, 439/352, 350, 357, 299

(56) References Cited

U.S. PATENT DOCUMENTS

| | | | | |
|---|---|---|---|---|
| 5,011,424 A | | 4/1991 | Simmons | 439/352 |
| 5,507,666 A | * | 4/1996 | Yamanashi | 439/354 |
| 6,083,052 A | | 7/2000 | Adams et al. | |
| 6,116,939 A | * | 9/2000 | Fukuda | 439/354 |
| 6,250,942 B1 | * | 6/2001 | Lemke et al. | 439/352 |
| 6,302,721 B1 | | 10/2001 | Turner et al. | 439/352 |
| 6,328,601 B1 | | 12/2001 | Yip et al. | |
| 6,358,091 B1 | | 3/2002 | Lo et al. | |
| 6,368,143 B1 | | 4/2002 | Adams | |
| 6,371,794 B1 | | 4/2002 | Bauer et al. | |
| 2003/0220008 A1 | | 11/2003 | Viklund et al. | 439/352 |

OTHER PUBLICATIONS

Office Action for U.S. Appl. No. 10/682,226 dated Sep. 27, 2004.

* cited by examiner

*Primary Examiner*—Renee Luebke
(74) *Attorney, Agent, or Firm*—Cantor Colburn LLP

(57) ABSTRACT

An axial latch actuator includes: a mating portion having a latch surface for engaging a jack; and a slidable housing that slides along the mating portion and engages the mating portion, wherein when the slidable housing slides in a first direction, the mating portion is in a latched position and when the slidable housing slides in a second direction, the mating portion is in an unlatched position.

15 Claims, 18 Drawing Sheets

AXIAL LATCH ACTUATOR

CROSS-REFERENCE TO RELATED APPLICATIONS

The present application claims the benefit of the date of the earlier filed provisional application, having U.S. Provisional Application No. 60/375,786, filed on Apr. 26, 2002, which is incorporated herein in its entirety.

BACKGROUND OF THE INVENTION

Many prevalent network systems, i.e., Ethernet, etc., require the use of a common modular plug. The modular plug includes opposing first and second ends. The first end is terminated with a cable. The second end is connected to a modular connector, thus forming a modular connection interface. The modular plug connects to a modular jack. The existing manner in which the modular plug is connected to the jack is through the use of a snap latching system, which is illustrated in FIG. 38. The user is required to push down on the latch to disengage the modular plug from the jack. When there are a number of modular plugs in close proximity (e.g., in a patch panel), each of the modular plugs are located next to each other and it is difficult for the user to reach the latch and disengage a specific modular plug.

SUMMARY OF THE INVENTION

The above discussed and other drawbacks and deficiencies of the prior art are overcome or alleviated by an axial latch actuator. In an exemplary embodiment, the axial latch actuator includes: a mating portion having a latch for engaging a jack; and a slidable housing that slides along the mating portion and engages the mating portion, wherein when the slidable housing slides in a first direction, the mating portion is in a latched position and when the slidable housing slides in a second direction, the mating portion is in an unlatched position.

BRIEF DESCRIPTION OF THE DRAWINGS

Referring now to the drawings wherein like elements are numbered alike in the several Figures.

DETAILED DESCRIPTION

Figure 1:
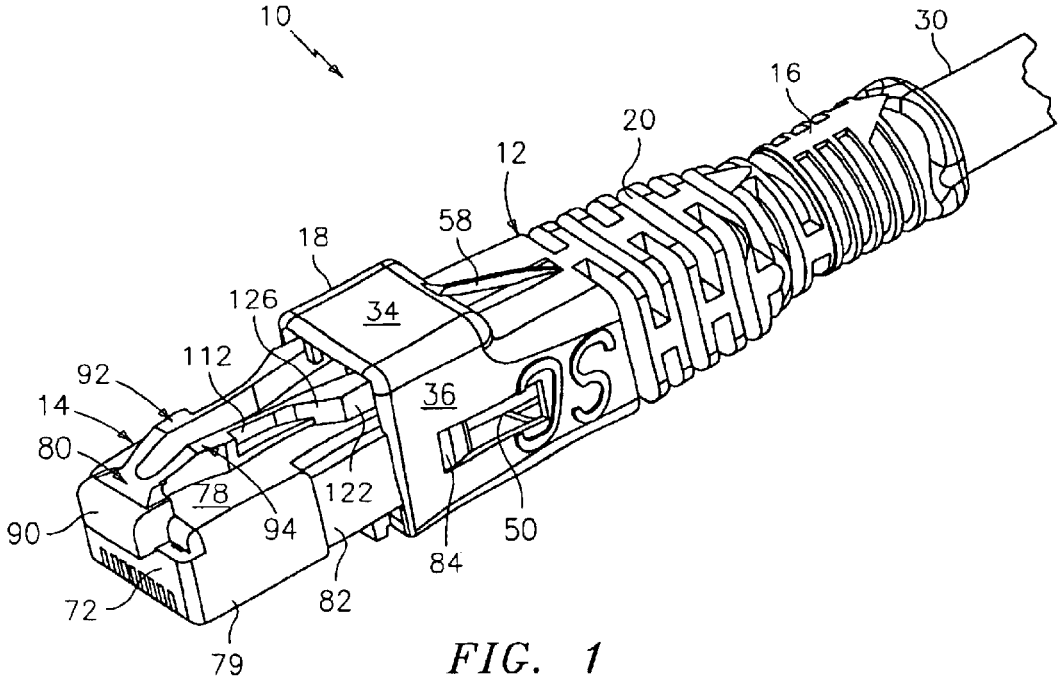
FIG. 1 is a front perspective view of a modular plug connected to a cable in an unlatched position.
Figure 2:
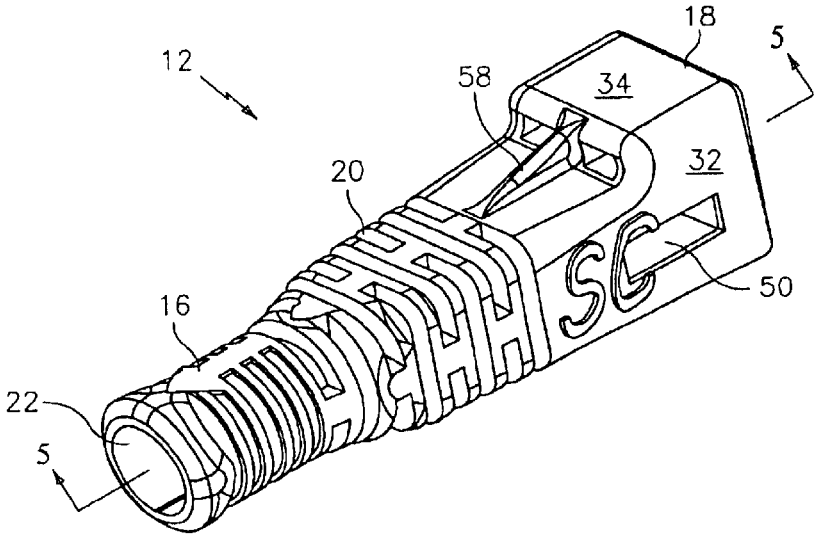
FIG. 2 is a back perspective views of a slidable housing of the modular plug of FIG. 1.
Figure 3:
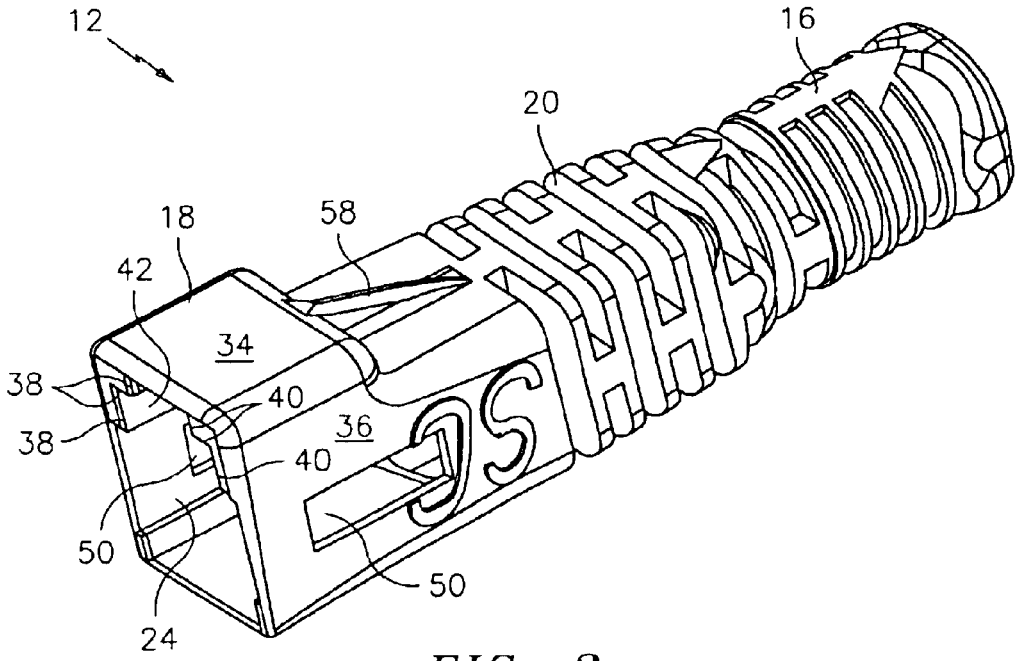
FIG. 3 is a front perspective view of a slidable housing of the modular plug of FIG. 1.
Figure 4:
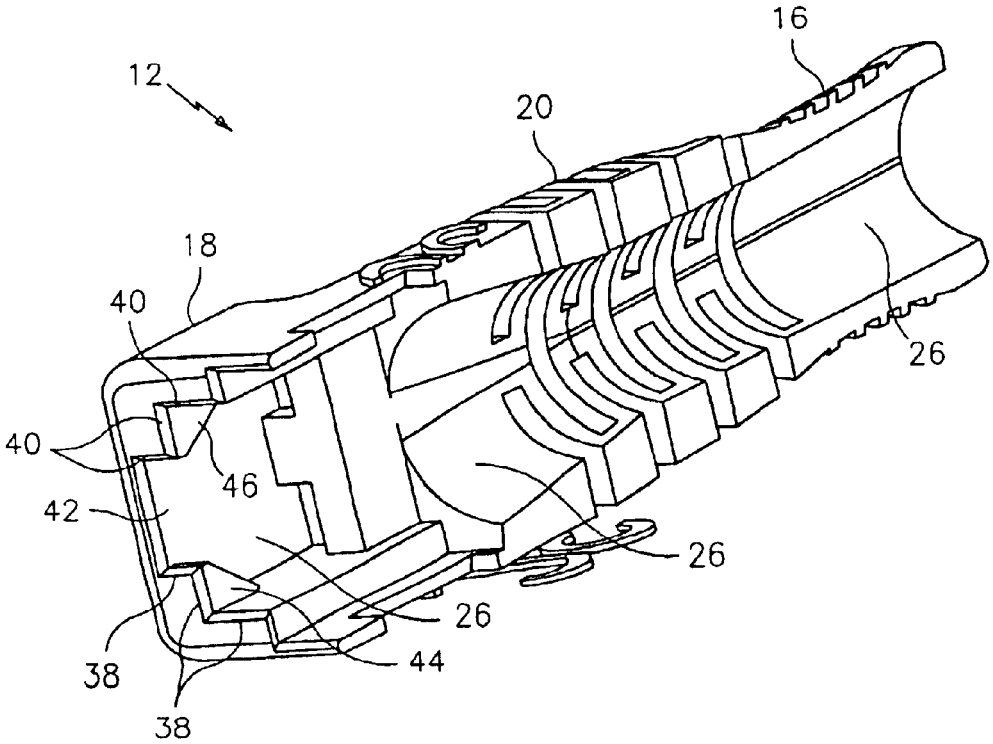
FIG. 4 is a perspective view of half the slidable housing of FIGS. 2–3.
Figure 5:
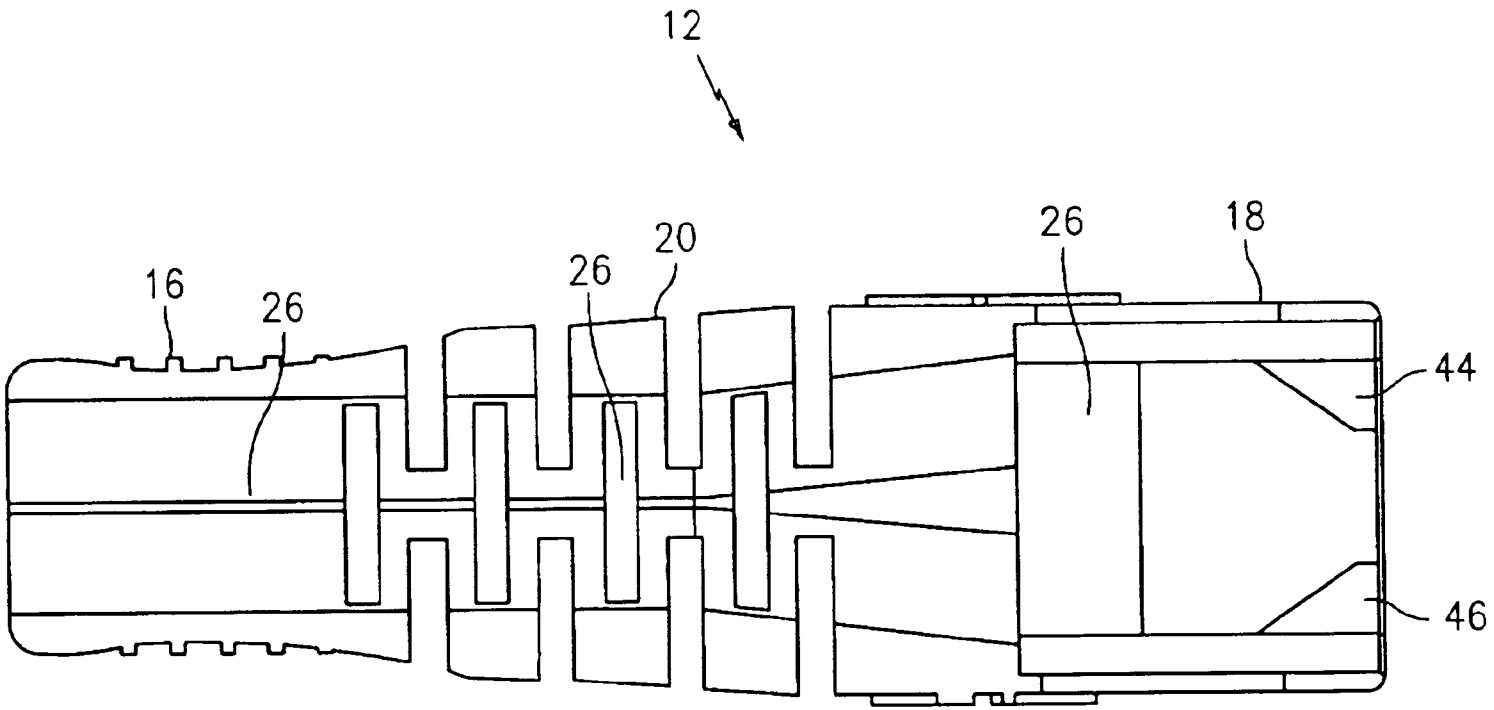
FIG. 5 is a bottom view of the inside of the slidable housing of FIG. 2.
Figure 6:
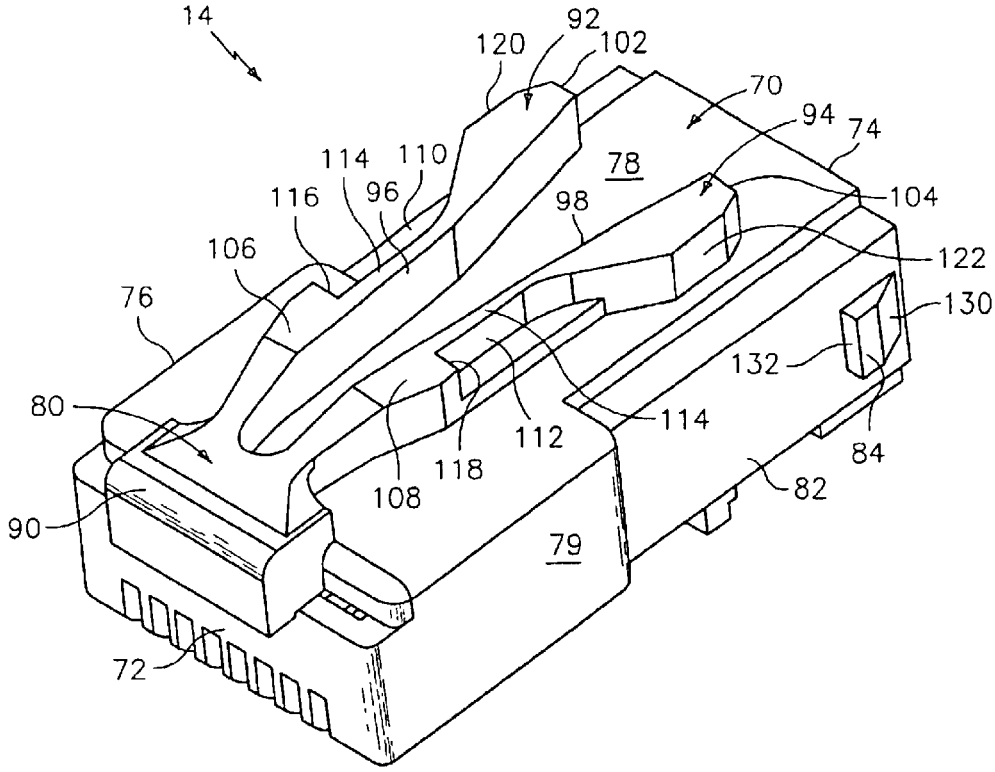
FIG. 6 is a front perspective view of a mating portion of the modular plug of FIG. 1.
Figure 7:
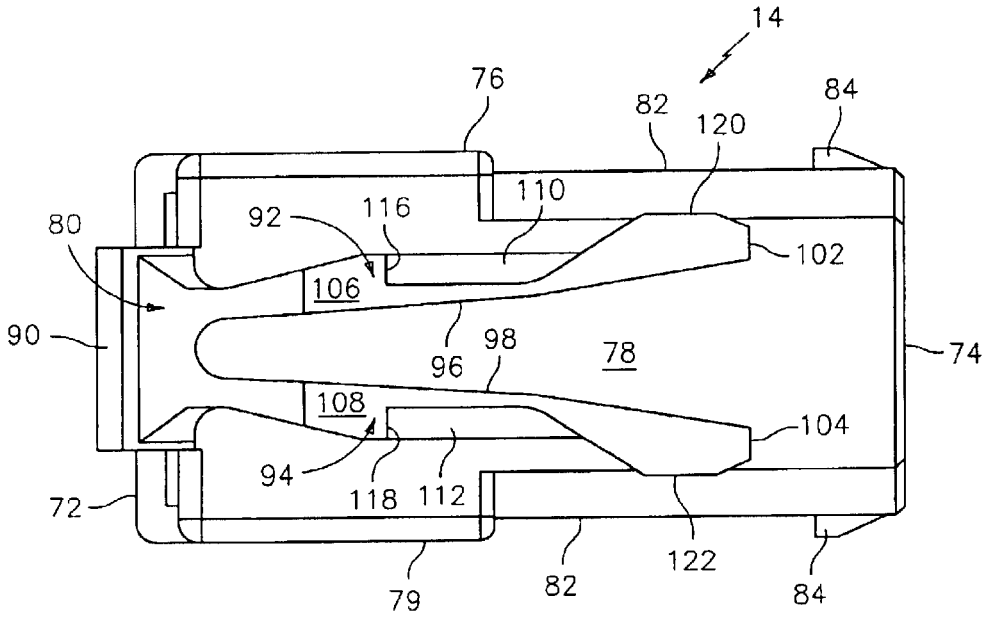
FIG. 7 is a top view of the mating portion of FIG. 6.
Figure 8:
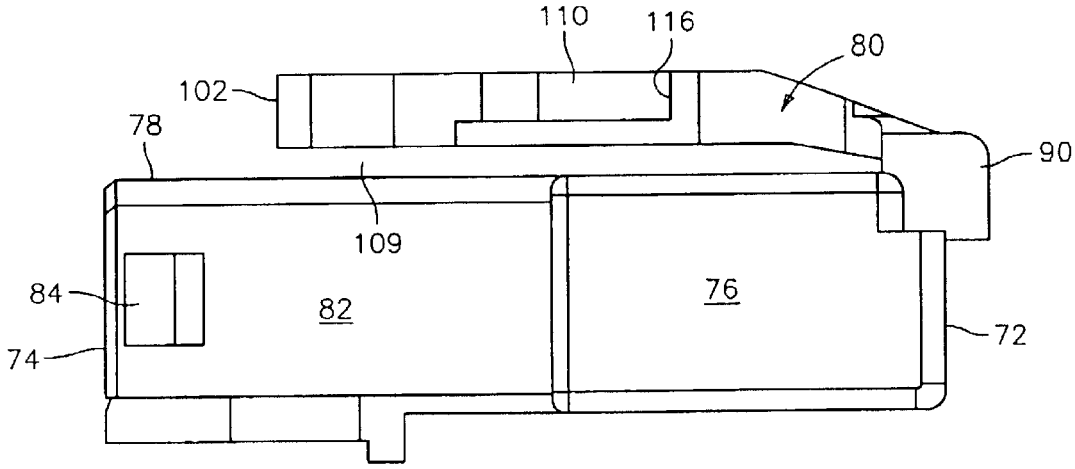
FIG. 8 is a side view of the mating portion of FIG. 6.
Figure 9:
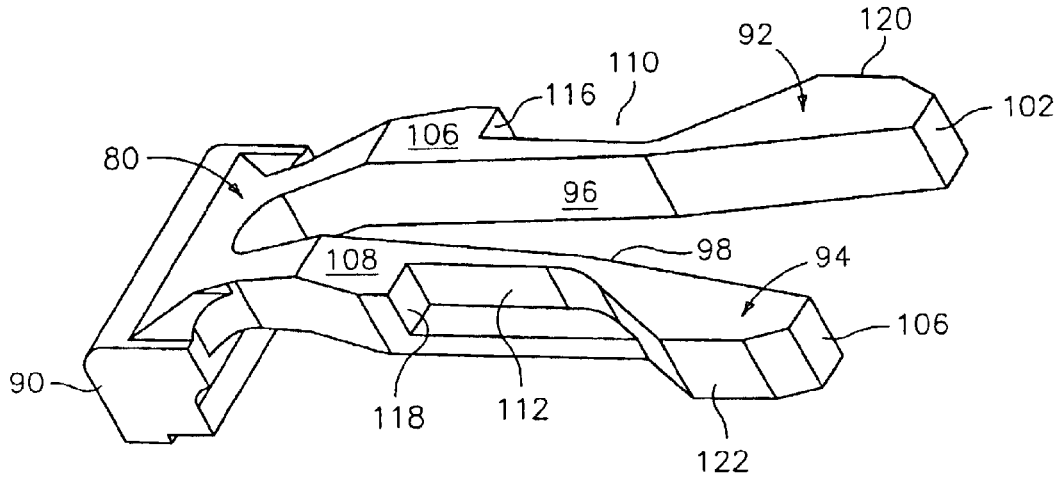
FIG. 9 is a side perspective view of a latch of the mating portion of FIG. 6.
Figure 10:
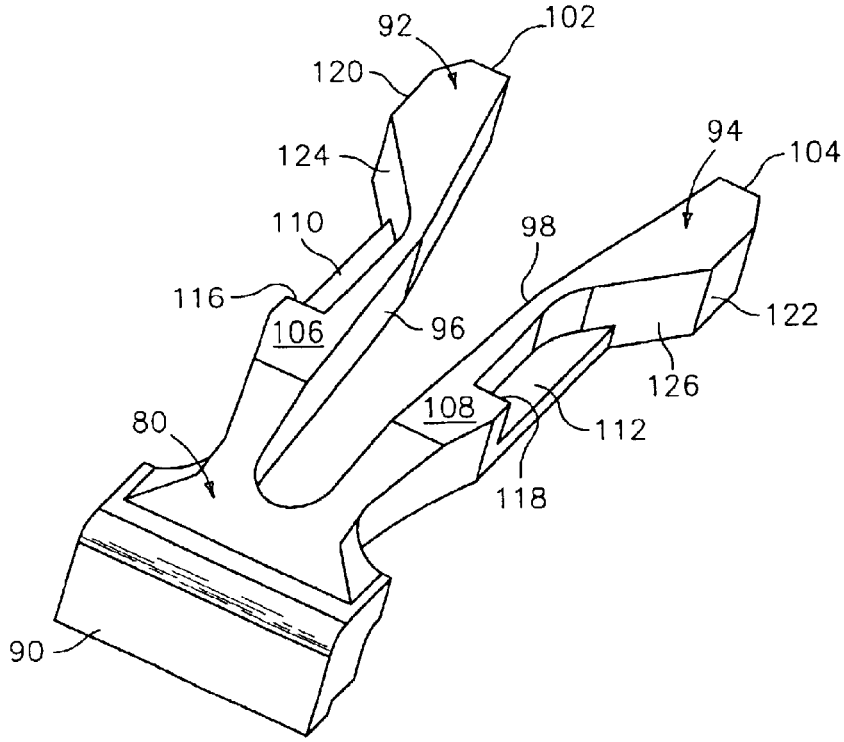
FIG. 10 is a side perspective view of a latch of the mating portion of FIG. 6.

Referring to FIG. 1, a modular plug 10 is illustrated. Plug 10 includes a slidable housing 12 and a mating portion 14. Mating portion 14 is partially received into housing 12.

Referring now to FIGS. 1–5, housing 12 has a first end 16, an opposing second end 18, and a middle portion 20. Both first end 16 and second end 18 have openings 22 and 24, with a chamber 26 disposed therebetween. Chamber 26 provides a pathway from first end 16 to second end 18. First end 16 is elongated to allow an operator to grasp housing 12. Opening 22 is sized to receive a cable 30.

Second end 18 is sized to receive mating portion 14. Second end 18 has a first side 32, a second side 34, and a third side 36. First side 32 is approximately parallel to third side 36, with second side 34 located approximately perpendicular to both first side 32 and third side 36.

Housing 12 includes contoured surfaces, which are located within chamber 26 and which engage mating portion 14. The contoured surfaces are as follows. A first stepped edge 38 is located at a corner of first side 32 and second side 34 and a second stepped edge 40 is located at a corner of second side 34 and third side 36. First stepped edge 38 mirrors second stepped edge 40 so as to form a cut out section 42 located at opening 24 and along second side 34. A first wedge 44 and a second wedge 46 are located within chamber 26 and directly behind first stepped edge 38 and second stepped edge 40, respectively. Both first side 32 and third side 36 have slots 50. Housing 12 generally tapers from second end 18 to first end 16, with second end 18 being larger than first end 16.

Second end 18 also has a sloped extension 58, which provides for a smooth transition from second end 18 to middle portion 20 and helps to prevent plug 10 from snagging as plug 10 is drawn through cabling areas.

Referring to FIGS. 1 and 6–10, mating portion 14 has a main body 70 with a first end 72 and an opposing second end 74. Main body 70 also has a first side 76, a second side 78, and a third side 79. First side 76 is approximately parallel to third side 79, with second side 78 located approximately perpendicular to both first side 76 and third side 79. Both first side 76 and third side 79 have indented portions 82. A plug stop 84 is located at second end 74 on both first side 76 and third side 79 at indented portions 82.

Mating portion 14 includes a latch 80 that is connected to first end 72 at a base 90. Latch 80 includes two fingers 92 and 94 that extend from base 90 over second side 78. Fingers have opposing sloped sides 96 and 98. Fingers 92 and 94 are located closest together at first end 72 and move apart from one another as fingers 92 and 94 extend away from base 90 over second side 78 to terminal ends 102 and 104. There is a gap 109 located between fingers 92 and 94 and second side 78. Accordingly, because fingers 92 and 94 are only attached at base 90 and merely extend over second side 78, fingers 92 and 94 can be pushed together in a scissors-like manner with the most movement occurring at terminal ends 102 and 104.

Fingers 92 and 94 also have top sides 106 and 108, which have cavities 110 and 112 that located at approximately a mid-section 114 of fingers 92 and 94. Cavities 110 and 112 include latch surfaces 116 and 118, which are generally perpendicular to top sides 106 and 108 of fingers 92 and 94. Terminal ends 102 and 104 of fingers 92 and 94 have outer surfaces 120 and 122 and sloped surfaces 124 and 126.

Referring to FIGS. 1–11, plug 10 is assembled as follows. Second end 74 of mating portion 14 is received into opening 24 of housing 12. Main body 70 slides into opening 24 until plug stops 84 are received into slots 50. Plug stops 84 have a sloped surface 130 and a tab side 132. Plug stops 84 will slide into opening 24 along sloped surface and then hook into slot 50 at tab side 132. When plug stops 84 are received into slots 50, terminal ends 102 and 104 are received into cut out section 42. This is the unlatched position, as indicated in FIG. 1.

Plug stops 50 keep mating portion 14 movably secured to slidable housing 12. In other words, mating portion 14 can slide within slidable housing 12; however, plug stops 50 ensure that mating portion 14 does not come apart from slidable housing 12 when the user disengages modular plug 10 from the jack.

Figure 11:
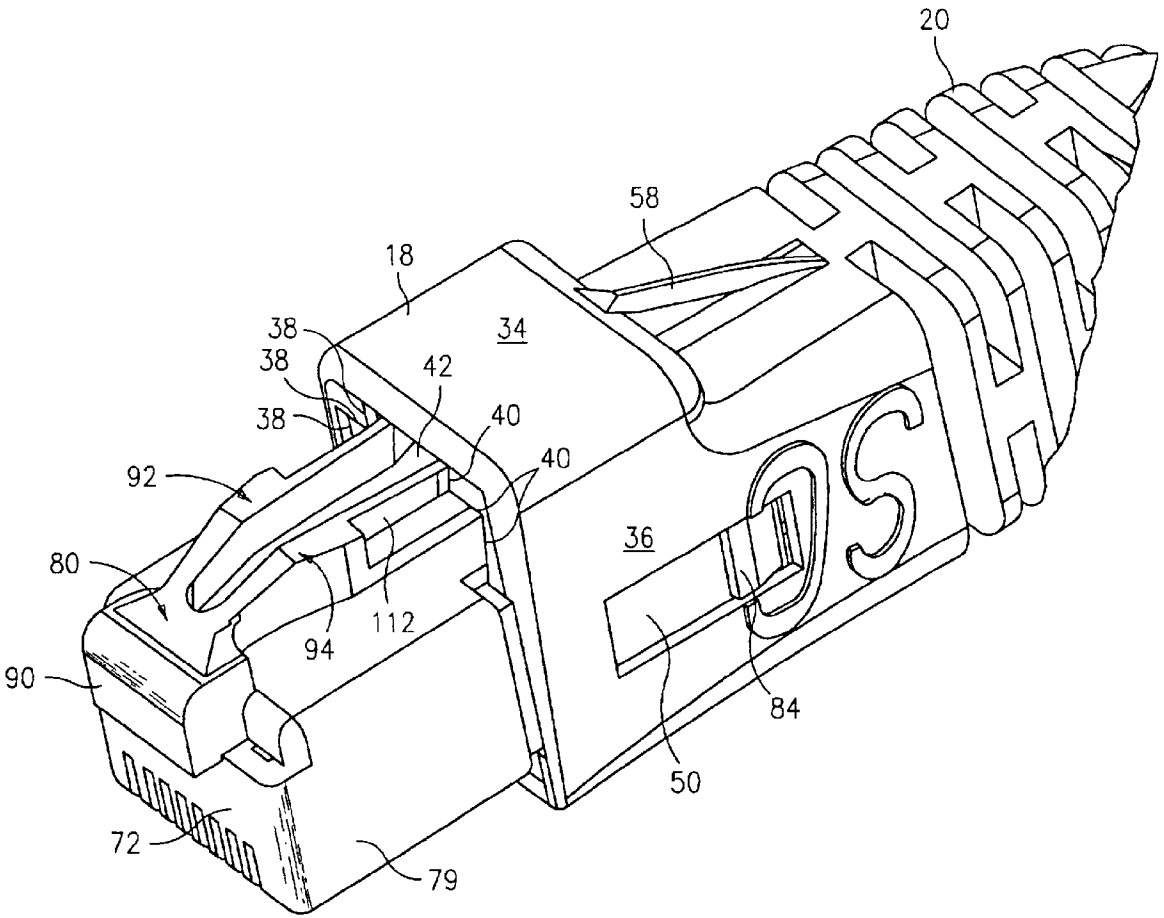
FIG. 11 is a front perspective view of the modular plug of FIG. 1 in a latched position.
Figure 12:
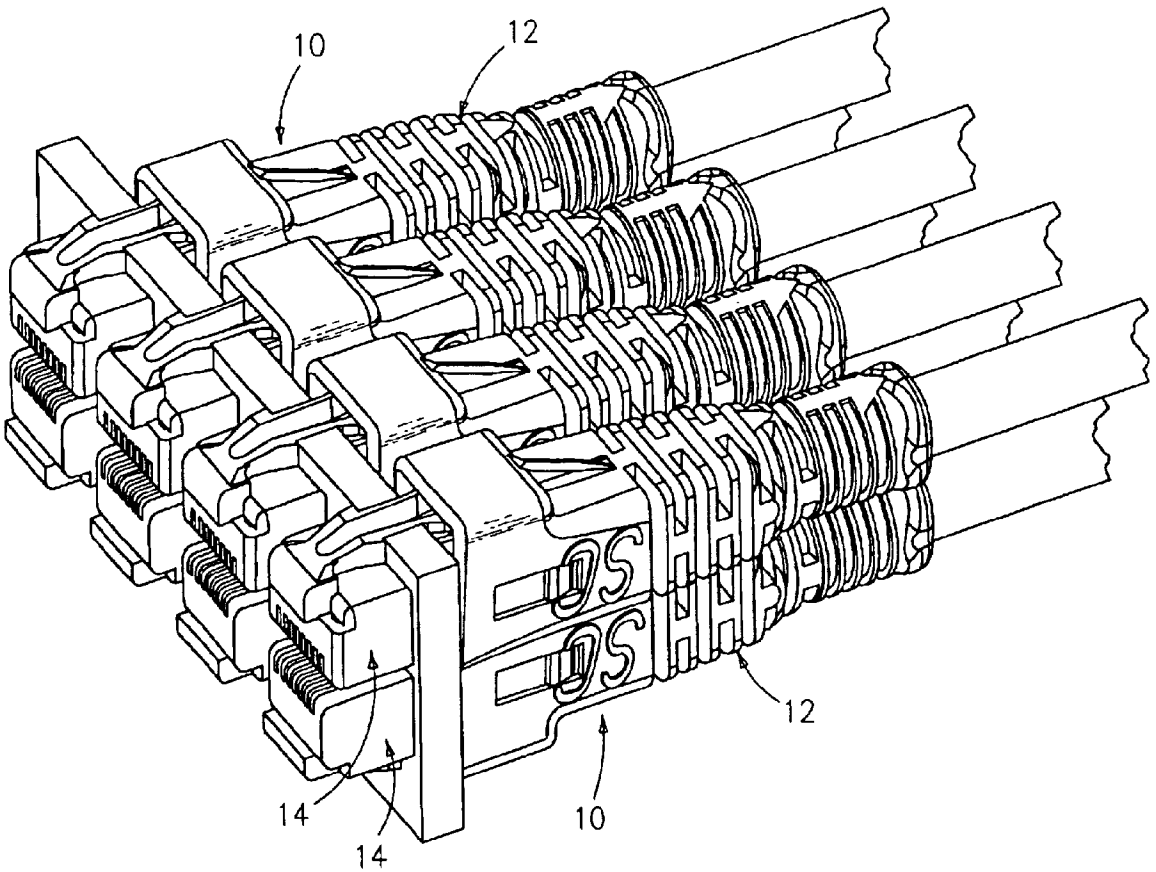
FIG. 12 is a front perspective views of a plurality of modular plugs connected to cables and to a patch panel.

As main body 70 continues to slide into opening 24 and into chamber 26, plug stops 84 slide along slots 50. In addition, fingers 92 and 94 slide along wedges 44 and 46. As sloped surfaces 124 and 126 engage with wedges 44 and 46, respectively, fingers 92 and 94 begin to move in an outward direction so that fingers 92 and 94 separate away from each other. Thus, the shape of wedges 44 and 46 and the shape of terminal ends 102 and 104 cause fingers 92 and 94 to move laterally in an outward direction towards first side 76 and third side 79, respectively. FIG. 11 indicates the latched position of plug in which housing 12 completely encloses indented portions 82 and fingers 92 and 94 are forced apart.

Figure 13:
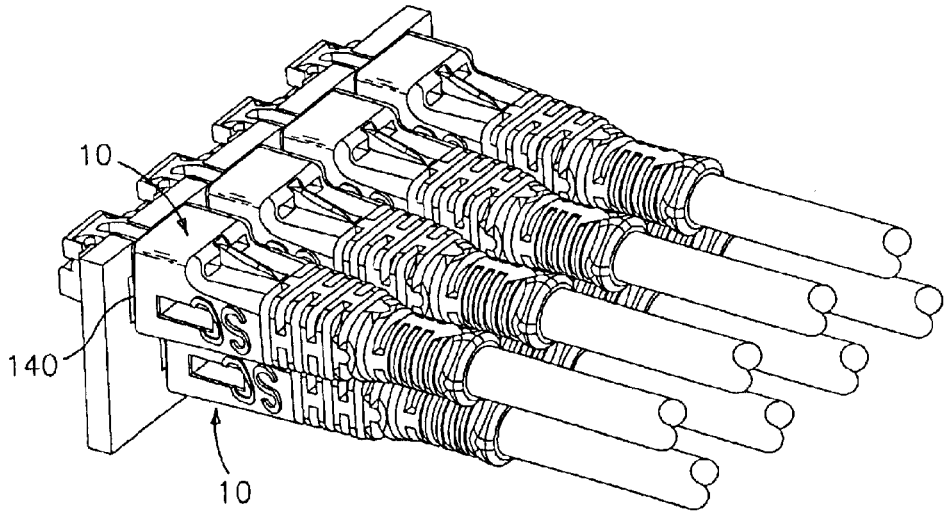
FIG. 13 is a back perspective views of a plurality of modular plugs connected to cables and to a patch panel.

Referring to FIGS. 1–13, plug 10 operates as follows. When plug 10 is in the unlatched position, as indicated in FIG. 1, the user grasps cable 30 at first end 16 of housing 12 and pushes mating portion 14 into a jack 140 (see FIG. 13). Jack 140 includes a RJ-45 jack. Once mating portion 14 has been inserted into jack 140, the user releases cable 30 and continues to grasp first end 16. The user pushes first end 16 towards jack 140. Housing 12 slides towards jack 140 so that plug stops 84 slide in slots 50 and fingers 92 and 94 slide into cut out section 42. As explained above, when fingers 92 and 94 slide into cut out section 42, wedges 44 and 46 engage sloped surfaces 124 and 126, which pushes fingers 92 and 94 in an outward lateral direction, as indicated in FIG. 11. This is the latched position. When this happens, latch surfaces 116 and 118 engage with the surfaces in jack 140 and lock plug 10 into jack 140. Thus, if the user releases housing 12 and grasps only cable 30 and pulls cable away from jack 140, plug 10 will not release from jack 140.

Plug 10 can be disengaged and released from jack 140 when the user grasps first end 16 and pulls in an outward direction, away from jack 140. When the user pulls on first end 16, terminal ends 102 and 104 slide along wedges 44 and 46, which pushes fingers 92 and 94 together. When fingers 92 and 94 are pushed together, latch surfaces 116 and 118 disengage from the surfaces of the jack 140, thereby releasing plug 10 from jack 140. This is the unlatched position.

Accordingly, when multiple cables are grouped together, an operator can grasp first end 16 of housing 12 and pull housing 12 so that it slides away from jack 140. When housing 12 is pulled away from jack 140, latch 80 disengages from jack 140 and releases mating portion 14 from jack 140.

Figure 14:
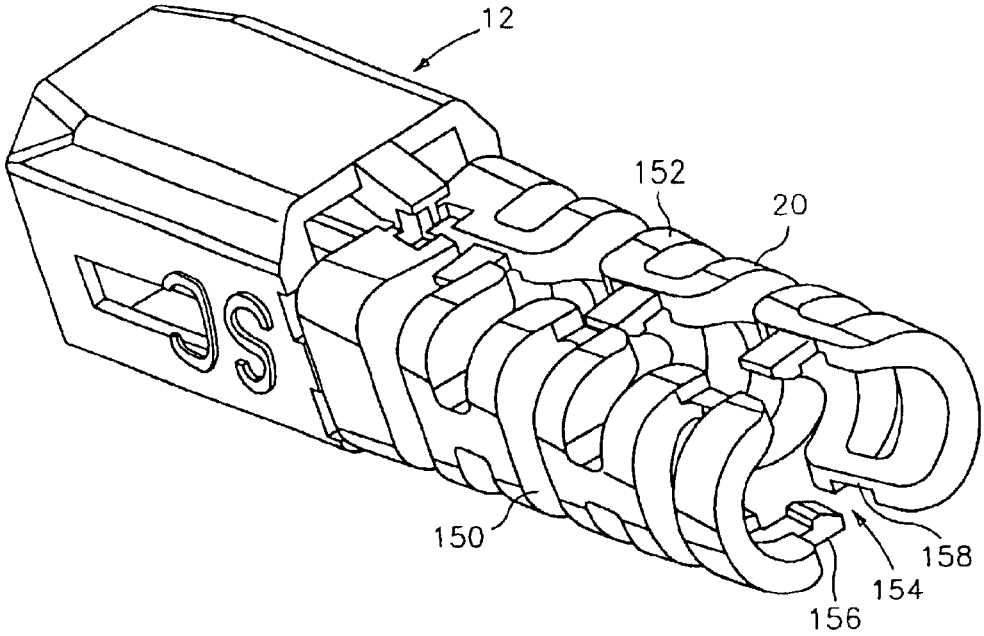
FIG. 14 is a back perspective view of an alternative embodiment of the slidable housing.
Figure 15:
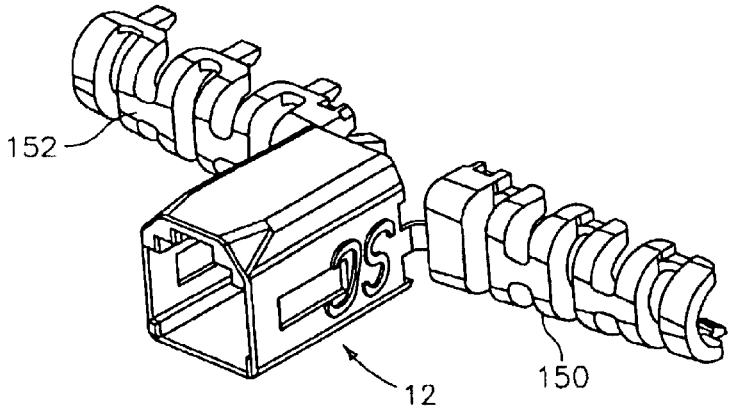
FIG. 15 is a front perspective view of the slidable housing of FIG. 14 in an open position.
Figure 16:
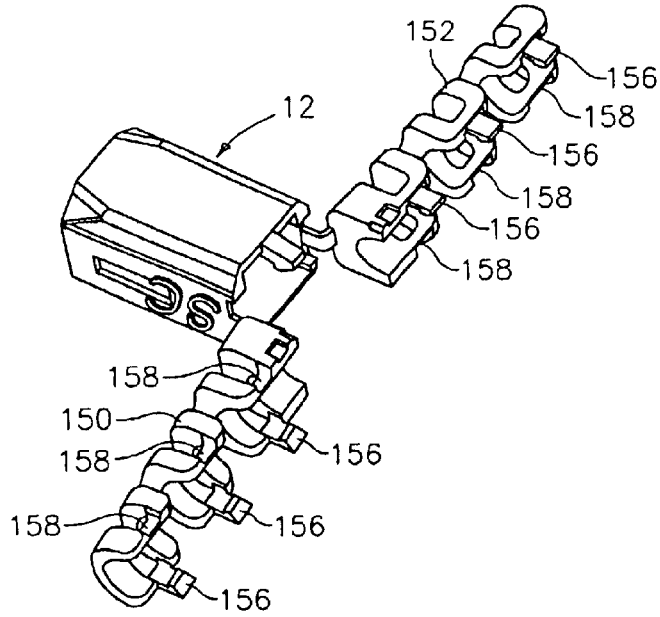
FIG. 16 is a back perspective view of the slidable housing of FIG. 14 in an open position.
Figure 17:
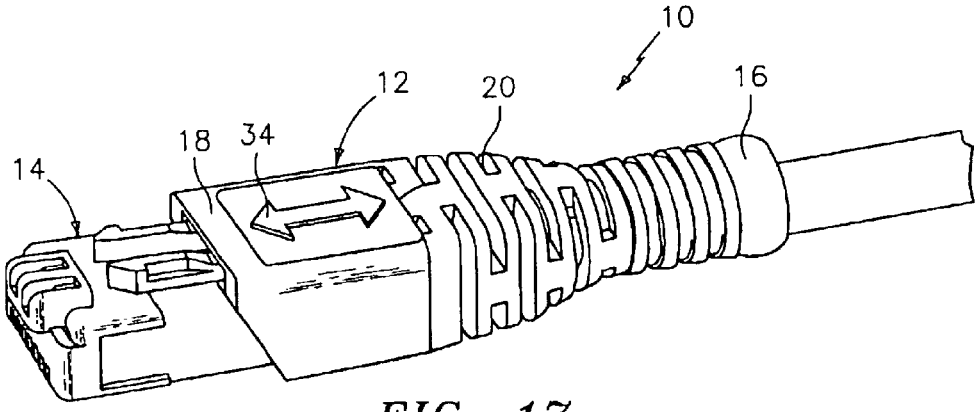
FIG. 17 is a side perspective views of an alternative embodiment of the modular plug.
Figure 18:
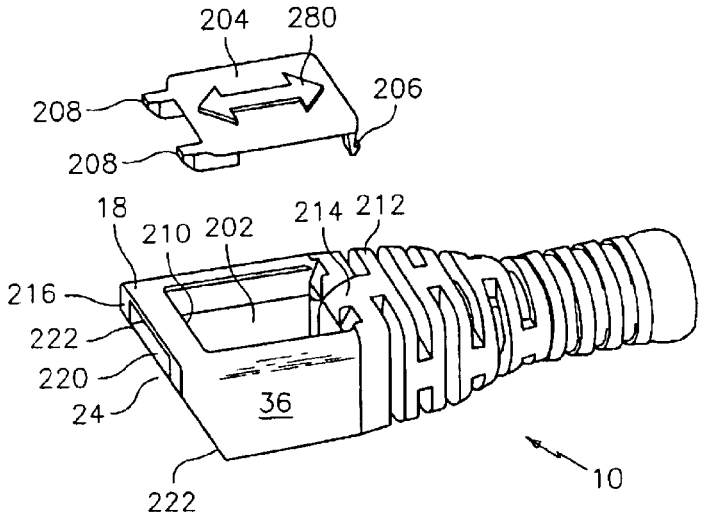
FIG. 18 is a side perspective view of the slidable housing of the modular plug of FIG. 17.
Figure 19:
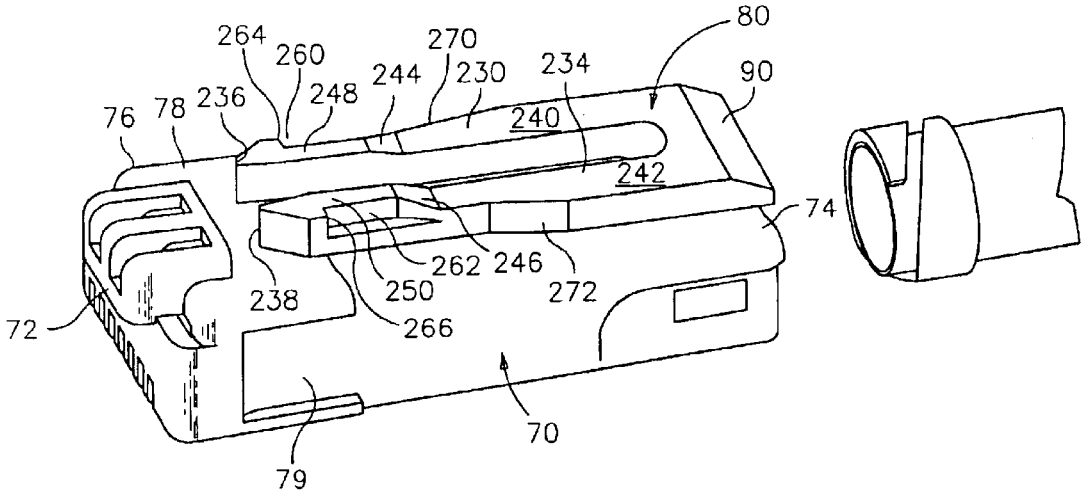
FIG. 19 is a side perspective view of the mating portion of the modular plug of FIG. 17.
Figure 20:
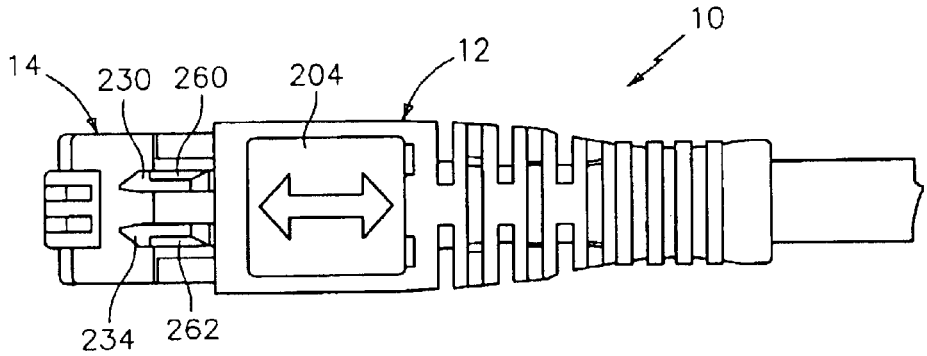
FIG. 20 is a top view of the modular plug of FIGS. 17–19.
Figure 21:
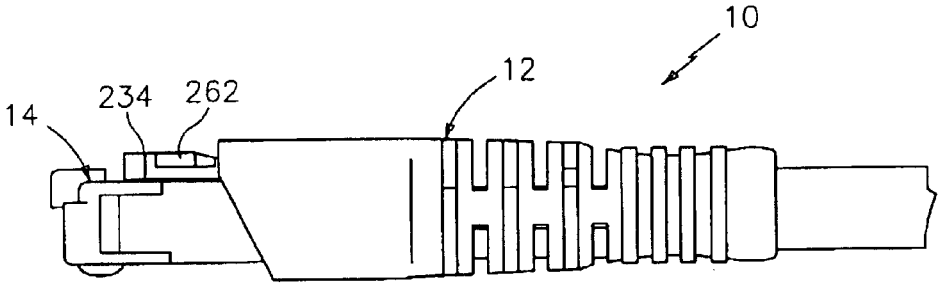
FIG. 21 is a side view of the modular plug of FIGS. 17–19.
Figure 22:
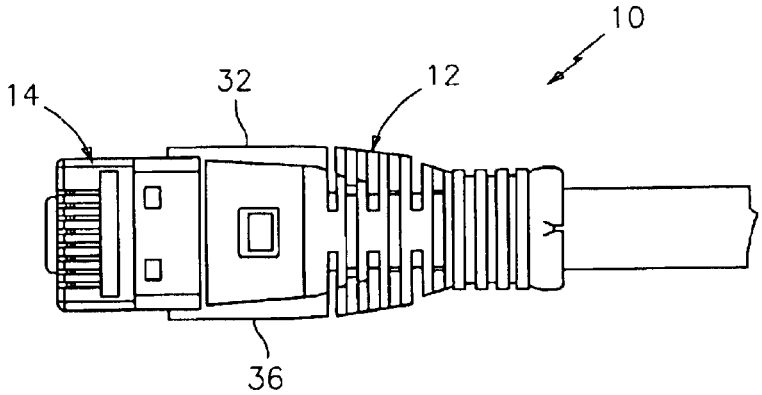
FIG. 22 is a bottom view of the modular plug of FIGS. 17–19.
Figure 23:
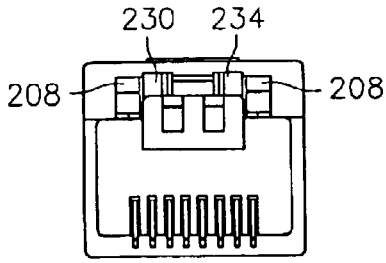
FIG. 23 is an end view of the modular plug of FIGS. 17–19.

Referring to FIGS. 14–16, an alternative embodiment of slidable housing 12 is illustrated. In this embodiment, first end 16 is removed and the user would grasp middle portion 20 to insert plug 10 (see FIG. 1) into jack 140 (see FIG. 13). In addition, middle portion 20 includes two sides 150 and 152 that swing away from each other. This type of housing allows for slidable housing 12 to clamp over cable 30 (see FIG. 1) in an easy manner. Sides 150 and 152 connected at a plurality of snap latches 154. Snap latches 154 include an extension 156 at sides 150 and 152 that hooks onto recess areas 158 at sides 150 and 152.

Referring to FIGS. 17–25, an alternative embodiment of modular plug 10 is illustrated. As with the first embodiment, plug 10 includes housing 12 and mating portion 14. Housing 12 includes first end 16, opposing second end 18, and middle portion 20. Second end 18 includes opening 24 and is sized to receive mating portion 14.

Housing 12 is similar to the first embodiment except for the differences set forth herein. As such, when describing this embodiment, all of the parts that remain the same have the same part numbers as with the first embodiment. Second end 18 has first side 32, second side 34, and third side 36. First side 32 is approximately parallel to third side 36, with second side 34 located approximately perpendicular to both first side 32 and third side 36. Second side 34 includes an opening 202 and a cover 204. Second end 18 also has an end face 216, which includes a rectangular slot 220. Cover 204 includes a gripper edge 206, two projections 208, and a stop 209 (shown in FIG. 24). Two projections 208 slide under a first edge 210 of opening 202 and gripper edge 206 hooks under a lip 212 of an opposing second edge 214 of opening 202. In addition, sides 32 and 36 do not have slots 50 as with the first embodiment, but rather have a sloped edge 222.

In addition, mating portion 14 is similar to the first embodiment except for the differences set forth herein. Mating portion 14 has main body 70 with first end 72 and opposing second end 74. Main body 70 also has first side 76, second side 78, and third side 79.

In this embodiment, latch 80 is connected to second end 74 at base 90. Latch 80 includes two fingers 230 and 232 that extend from base 90 over second side 78. Fingers 230 and 234 are generally parallel and extend away from base 90 over second side to terminal ends 236 and 238. While this embodiment depicts fingers 230 and 234 disposed in a generally parallel manner, fingers 230 and 234 are not required to be parallel in order for fingers 230 and 234 to function properly. In addition, because fingers 230 and 234 are only attached at base 90 and merely extend over second side 78, fingers 230 and 234 can be pushed together in a scissors-like manner with the most movement occurring at terminal ends 236 and 238.

Fingers 230 and 234 also have top sides 240 and 242, which have sloped surfaces 244 and 246 leading to top sides 248 and 250. As such, terminal ends 236 and 238 are thicker than fingers 230 and 234 at base 90. Top sides 248 and 250 have cavities 260 and 262 that located near terminal ends 236 and 238. Cavities 260 and 262 include latch surfaces 264 and 266, which are generally perpendicular to top sides 248 and 250. In addition, cavities 260 and 262 mirror each other on each finger 230 and 236.

Figure 24:
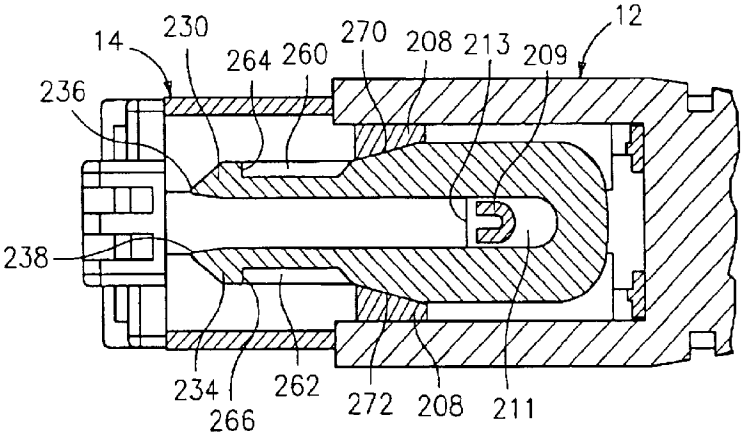
FIG. 24 is a top cross–sectional view of the modular plug of FIGS. 17–19 in a latched position.
Figure 25:
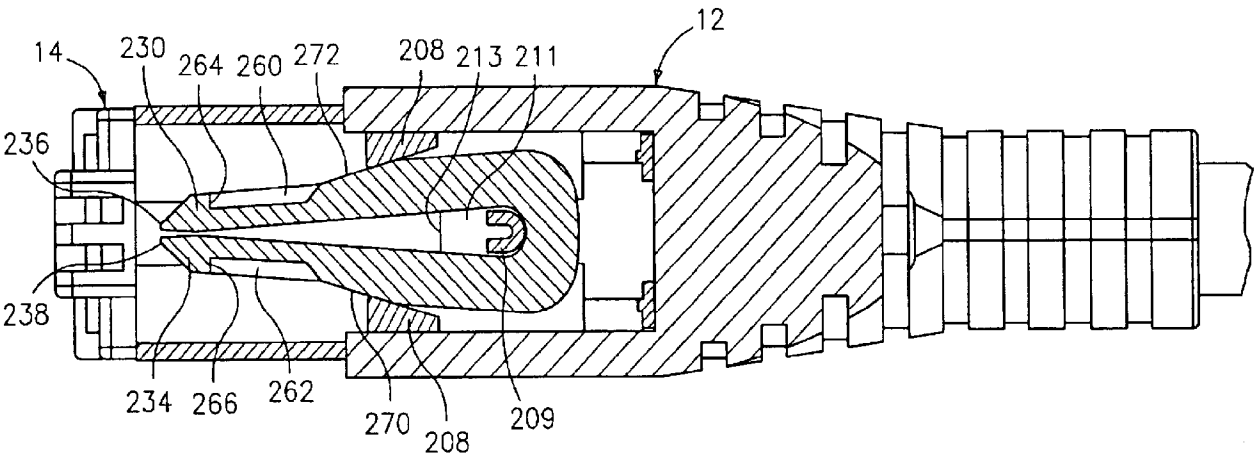
FIG. 25 is a top cross–sectional view of the modular plug of FIGS. 17–19 in an unlatched position.
Figure 26:
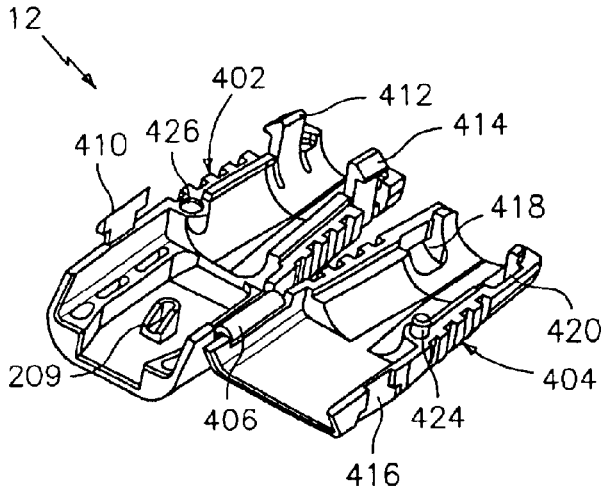
FIG. 26 is a front perspective views of an alternative embodiment of a slidable housing in an open position for the modular plug of FIGS. 17–19.
Figure 27:
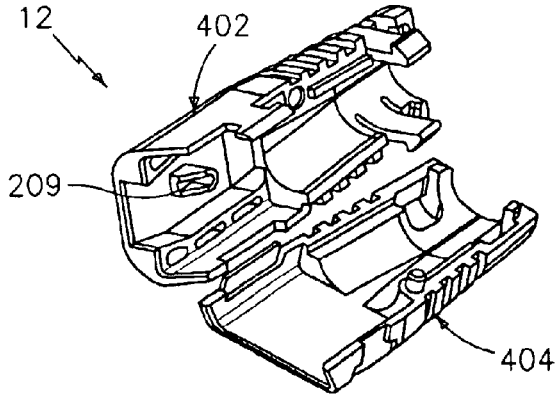
FIG. 27 is another front perspective view of the slidable housing of FIG. 26.
Figure 28:
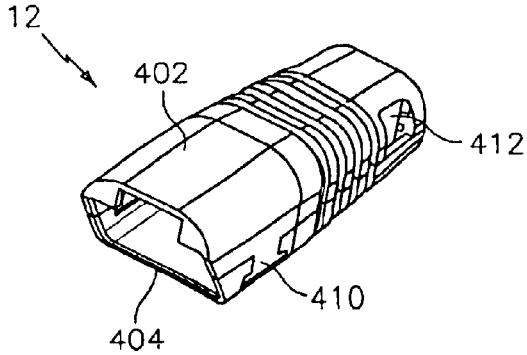
FIG. 28 is a front perspective view in the closed position of the slidable housing of FIG. 26.
Figure 29:
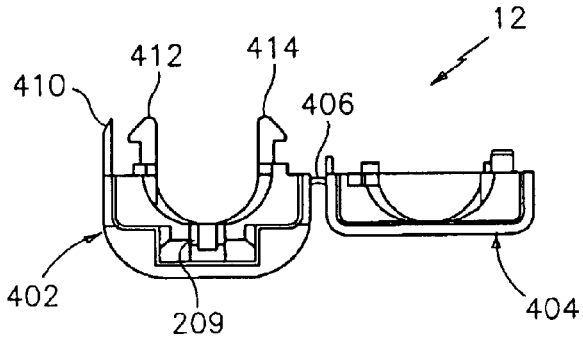
FIG. 29 is an end view of the slidable housing of FIGS. 26–28 in the open position.
Figure 30:
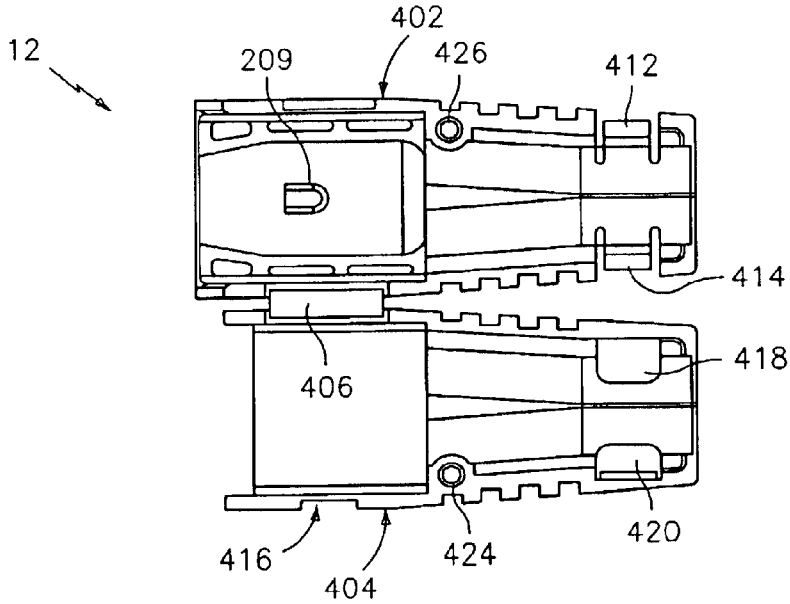
FIG. 30 is a top view of the slidable housing of FIGS. 26–28 in the open position.
Figure 31:
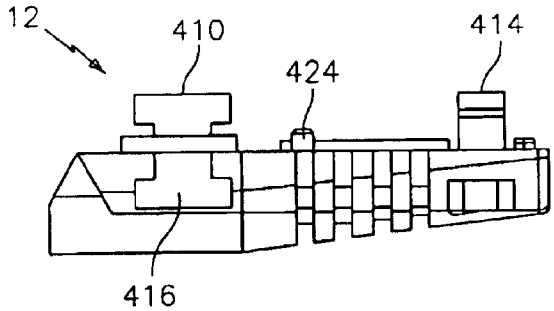
FIG. 31 is a side view of the slidable housing of FIGS. 26–28 in the open position.
Figure 32:
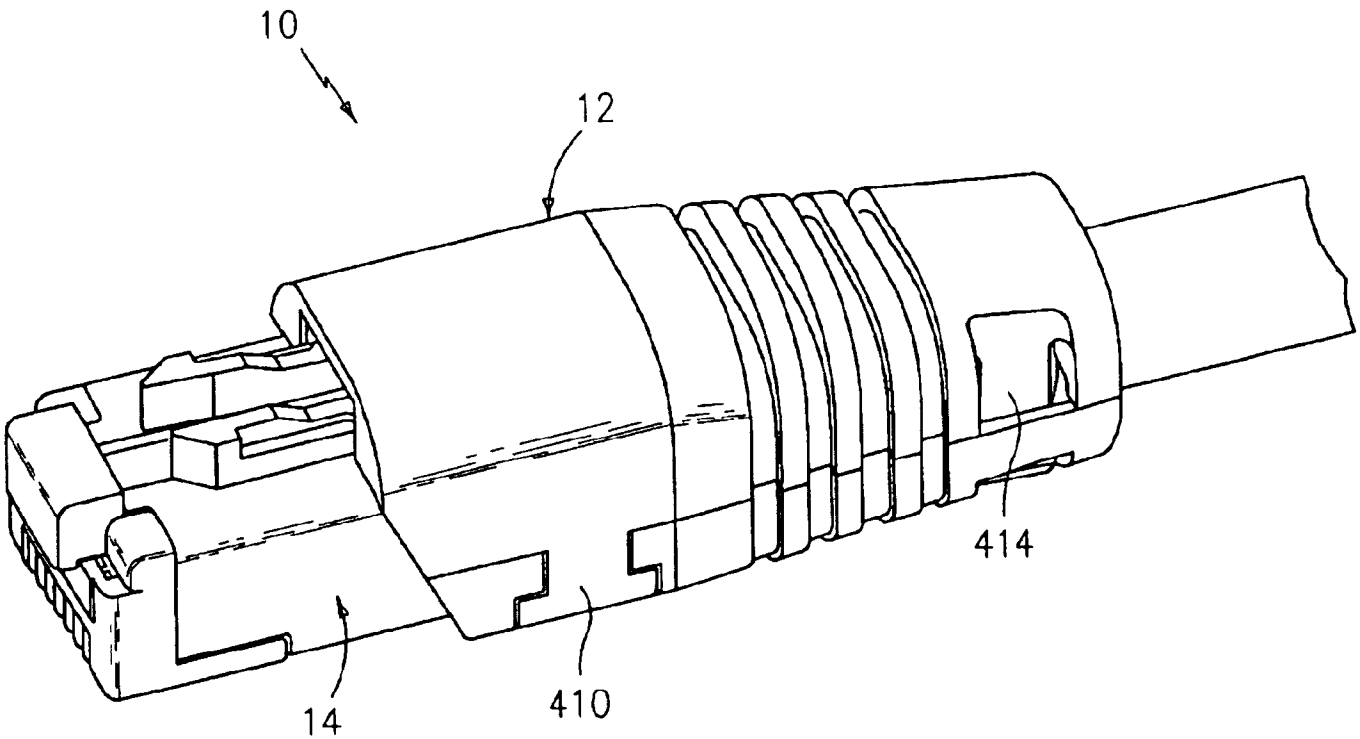
FIG. 32 is a perspective view of the modular plug with the slidable housing of FIGS. 26–28.
Figure 33:
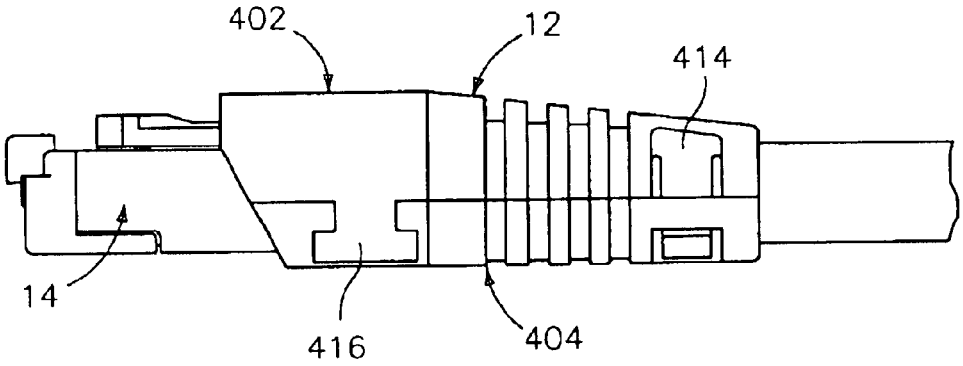
FIG. 33 is a side view of the modular plug with the slidable housing of FIGS. 26–28.
Figure 34:
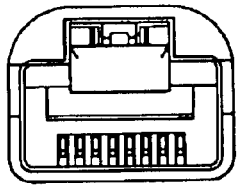
FIG. 34 is an end view of the modular plug with the slidable housing of FIGS. 26–28.
Figure 35:
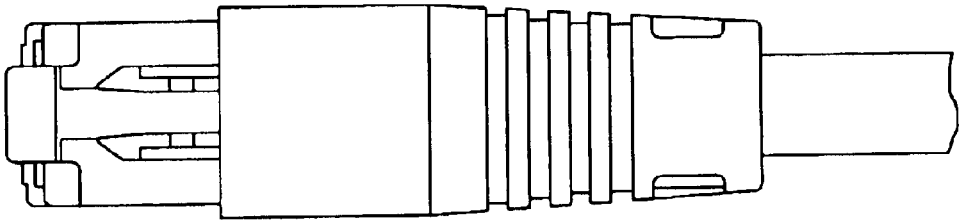
FIG. 35 is a top view of the modular plug with the slidable housing of FIGS. 26–28.

Cover 204 includes stop 209, which is located between fingers 230 and 236 when cover 204 is attached to housing 12. Stop 209 extends into a cavity 211, which is formed by fingers 230 and 236, wall 211, and the back end of fingers 230 and 236. Cavity 211 is set into second side 78 of mating portion 14. Stop 209 can slide within cavity 211, as shown in FIGS. 24 and 25. Stop 209 has the same function as plug stops 84. Stop 209 keeps mating portion 14 movably secured to slidable housing 12. In other words, mating portion 14 can slide within slidable housing 12; however, stop 209 ensures that mating portion 14 does not come apart from slidable housing 12 when the user disengages modular plug 10 from the jack.

Fingers 230 and 234 also have cam surfaces 270 and 272, which are located at about a mid-point along the outer side of fingers 230 and 234.

Referring to FIGS. 17–25, plug 10 is assembled as follows. Cover 204 is removed from housing 12. Second end 74 of mating portion 14 is received into opening 24 of housing 12. Base 90 extends into slot 220. Mating portion 14 slides into housing until sloped surfaces 244 and 246 contact end face 216. Cover 204 is fitted into opening 202 by sliding projections 208 into opening 24 first and then gripper edge 206 is snapped under lip 212. Projections 208 rest along cam surfaces 270 and 272 as shown in FIG. 24. This is the latched position of modular plug 10.

Once cover 204 is in place, cover 204 can slide in the direction of arrow 280. When cover 204 slides towards second edge 214, projections slide along cam surfaces 270 and 272 until projections 208 are at the edge of cam surfaces 270 and 272, as shown in FIG. 25. As projections 208 slide along cam surfaces 270 and 272, fingers 230 and 234 are pressed together. This is the unlatched position of modular plug 10.

Referring to FIGS. 13 and 17–25, plug 10 operates as follows. To mate the plug 10 with a jack, the plug may be placed in the unlatched position as shown in FIG. 25, inserted in the jack and then placed in the latched position shown in FIG. 24. Alternatively, when plug 10 is in the latched position, as indicated in FIG. 24, the user grasps first end 16 of housing 12 and pushes mating portion 14 into a jack 140 (see FIG. 13). Mating portion 14 slides into jack 140 until latch surfaces 264 and 266 engage with the surfaces in jack 140 and lock plug 10 into jack 140.

Plug 10 can be disengaged and released from jack 140 when the user grasps first end 16, and slides cover 204 away from the first end 72 of mating portion 14. As cover 204 slides toward second edge 214, fingers 230 and 234 press together and release the jack surfaces from latch surfaces 264 and 266 so that mating portion 14 is no longer engaged with jack 140, thereby releasing plug 10 from jack 140. This is the unlatched position of the modular plug 10. Thus, in this embodiment, only the cover 204 of housing 12 slides to disengage plug 10 from jack 140.

Referring to FIGS. 26–35, an alternative embodiment of slidable housing 12 is illustrated. In this embodiment, slidable housing 12 opens so that there is a top side 402 and a bottom side 404. In addition, there is no separate cover (see FIG. 18 with separate cover 204) and stop 209 extends from top side 402. Top side 402 may be connected to bottom side by a hinge 406. Top side 402 is secured to bottom side 404 by snap hooks 410, 412, and 414, all of which extend from top side 402, however, they could also extend from bottom side 404. Snap hooks are received into openings 416, 418, and 420, which are all sized to received the corresponding snap hooks and are disposed on bottom side 404. In addition, bottom side has a connector 424, which extends from bottom side 404 and is received into an opening 426, which is located on top side 402.

When assembling slidable housing 12 with mating portion 14, mating portion 14 is placed into bottom side 404 and top side 402 is closed over mating portion 14. Once top side 402 is secured to bottom side 404, mating portion cannot slide out of slideable housing 12 because stop 209 prevents mating portion 14 from sliding out of slideable housing 12. This embodiment of slideable housing 12 operates in the same manner as described above with respect to FIGS. 13 and 17–25.

Figure 36:
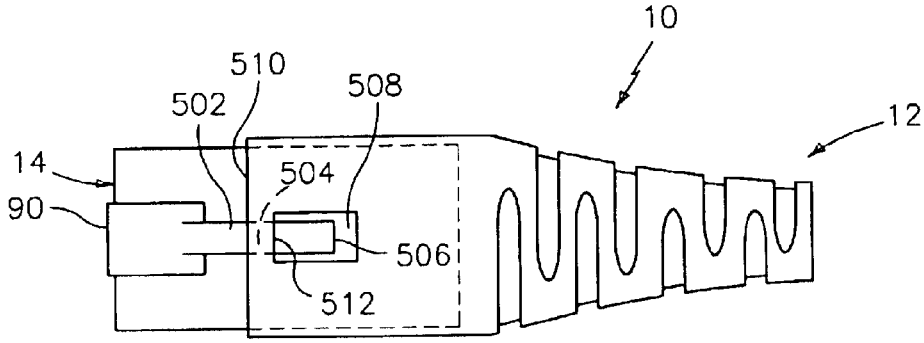
FIG. 36 is a top view of an alternative embodiment of the modular plug.
Figure 37:
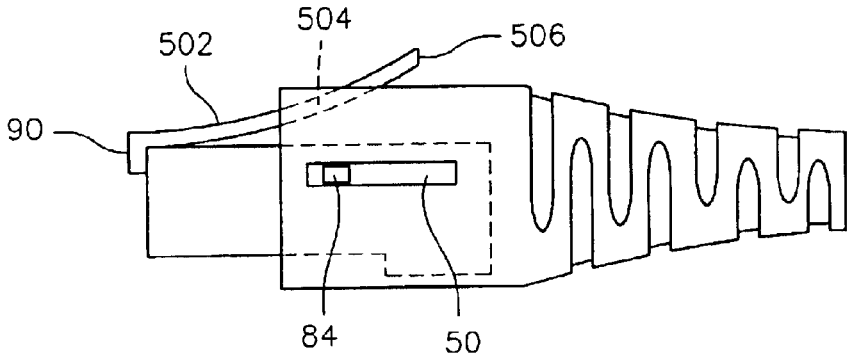
FIG. 37 is a side view of the modular plug of FIG. 35.
Figure 38:
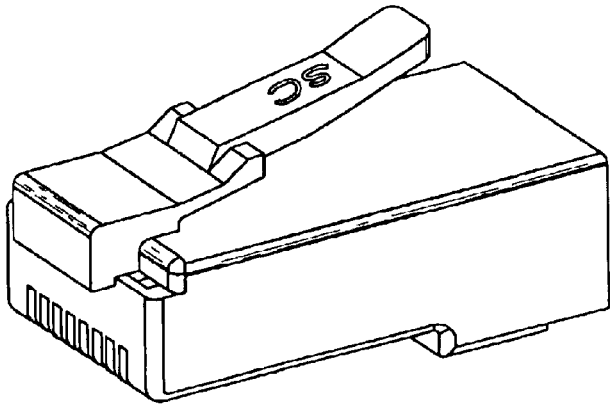
FIG. 38 (PRIOR ART)
FIG. 38 is a prior art latching system of a modular plug mating portion.

FIGS. 36 and 37 show an alternative embodiment of modular plug 10. In this embodiment, mating portion 14 has latch 502 extending from base 90. Latch 502 has a bend location 504 so that latch 502 bends away from second side 78 of mating portion. Latch 502 extends to an end 506. Slidable housing 12 has a window 508 that receives end 506 of latch 502.

Modular plug 10, which is shown in FIGS. 36–37, is assembled in the following manner. Mating portion 14 is received into chamber 26 of slidable housing 12 by sliding mating portion 14 into chamber 26. End 506 slides through window 508. Once end 506 is located in window 508, but before a front face 510 of slidable housing 12 reaches bend location 504 of latch 502, modular plug 10 is in the unlatched position. The modular plug 10 is now ready to be mated with a jack. Mating portion 14 is inserted into the jack and the user continues to slide slidable housing 12 continues to over mating portion 14 until front face 510 reaches bend location 504. This is the latched position. Once modular plug 10 is in the latched position, the user would then grasp slidable housing 12 and slide housing 12 in the opposite direction. As the user pulls the slidable housing 12 a cam surface 512 of window 508 pushes down on latch 502, which disengages mating portion 14 from the jack. In addition, slidable housing 12 includes slots 50, which engage plug stops 84.

The mating portion shown in the drawings is an RJ-45 plug having eight contacts, preferably used with cable having four twisted pairs of copper wire. One of the advantages of the axial latch actuator is that it can be mated with a standard outlet, which has not been modified. In other words, a face of the jack is flush with the opening of the jack so that the modular plug directly abuts the face of the jack. See FIG. 13. It is also understood that the mating portion may be altered to mate with non RJ-45 jacks and may be used with a variety of cable types such as coaxial cable, single fiber, duplex fiber, etc. Thus, embodiments of the invention are not limited to RJ-45, copper wire installations.

While the invention has been described with reference to exemplary embodiments, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiments disclosed for carrying out this invention.

What is claimed is:

1. An axial latch actuator comprising:

a mating portion having a latch for engaging a jack; and a slidable housing that slides along said mating portion and engages said mating portion, wherein when said slidable housing slides in a first direction, said mating portion is in a latched position and when said slidable housing slides in a second direction, said mating portion is in an unlatched position, said latch further comprises a first finger and a second finger, said first finger having a first end and a second end, said first end is connected to said mating portion at said first end and extends over a surface of said mating portion, said second finger is disposed adjacent to said first finger and connected to said mating portion at a same end as said first finger, said second finger extends over said surface of said mating portion.

2. The actuator of claim 1, wherein a mating end is sized to be received into a RJ-45 jack in which a face of the RJ-45 jack is flush with an opening within the RJ-45 jack.

3. The actuator of claim 1, wherein said first finger further comprises a cavity having a latch surface, said latch surface engages the jack.

4. The actuator of claim 1, wherein said slidable housing has a contoured interior, said contoured interior is shaped to engage said first finger.

5. The actuator of claim 4, wherein said second end includes an outer surface and a sloped surface, said contoured interior engages said outer surface and said sloped surface.

6. The actuator of claim 1, wherein said second end is configured so that it is free to moves in a lateral direction across said surface of said mating portion.

7. The actuator of claim 1, wherein when said mating portion is in said latched position, said first finger and second finger are forced apart.

8. The actuator of claim 1, wherein said slidable housing includes a removable cover that includes a projection.

9. The actuator of claim 1, wherein said first finger includes a mid section that has a cam surface, said projection engages said cam surface.

10. The actuator of claim 1, wherein said first direction is in an opposite direction from said second direction.

11. An axial latch actuator comprising:

a mating portion having a latch for engaging a jack; and a slidable housing that slides along said mating portion and engages said mating portion, wherein when said slidable housing slides in a first direction, said mating portion is in a latched position and when said slidable housing slides in a second direction, said mating portion is in an unlatched position, wherein said slidable housing includes a slot, said mating portion includes a plug stop, said plug stop is received into said slot.

12. A method of assembling an axial latch actuator, the method comprising:

sliding a mating portion into a housing, said mating portion having a latch for engaging a jack; and engaging said mating portion with a slidable housing, wherein when said slidable housing slides in a first direction, said mating portion is in a latched position and when said slidable housing slides in a second direction, said mating portion is in an unlatched position, said slidable housing is configured to slidably engage a cam surface so as to disengage said latch with said jack;

receiving a plug stop into a slot, said slot disposed in said housing.

13. An axial latch actuator comprising:

a mating portion having a latch for engaging a jack, said latch having a cam surface; and a slidable housing that is configured to receive said mating portion, said mating portion slides within said slidable housing, said slidable housing is configured to slidably engage said cam surface so as to disengage said latch with said jack, wherein said slidable housing includes an end portion that extends over a cable that is operably coupled to said mating portion.

14. The actuator of claim 13, wherein said end portion has a first side and a second side, said first side includes an extension that is received into a recess located at said second side.

15. An axial latch actuator comprising:

a mating portion having a latch for engaging a jack, said latch having a cam surface; and a slidable housing that is configured to receive said mating portion, said mating portion slides within said slidable housing, said slidable housing is configured to slidably engage said cam surface so as to disengage said latch with said jack, wherein said slidable housing includes a window that receives said latch and engages said latch at said cam surface.

* * * * *